US005183227A

United States Patent [19]

Wilhite

[11] Patent Number: 5,183,227

[45] Date of Patent: Feb. 2, 1993

[54] SELF-CLOSING BAG HOLDER

[75] Inventor: Gerald D. Wilhite, Duncanville, Tex.

[73] Assignee: Jokari/US., Inc., Dallas, Tex.

[21] Appl. No.: 819,466

[22] Filed: Jan. 10, 1992

[51] Int. Cl.[5] ..... B65B 67/04

[52] U.S. Cl. ..... 248/99

[58] Field of Search ..... 248/99, 100, 101, 95, 248/97; 220/404; 141/314, 391

[56] References Cited

U.S. PATENT DOCUMENTS

| | | | |
|---|---|---|---|
| 3,412,965 | 11/1968 | Alexander | 248/101 |
| 3,426,958 | 2/1969 | Gore | 248/99 X |
| 3,724,921 | 4/1973 | Lake | 248/99 X |
| 3,861,630 | 1/1975 | Ady | 248/101 X |
| 3,912,208 | 10/1975 | Grenetier | 248/99 |
| 4,069,944 | 1/1978 | Wharmby | 248/99 X |
| 4,815,866 | 3/1989 | Martone | 383/34.1 |

FOREIGN PATENT DOCUMENTS

| | | |
|---|---|---|
| 1073895 | 6/1967 | United Kingdom . |
| 1526262 | 9/1978 | United Kingdom . |
| 2120532A | 12/1983 | United Kingdom . |
| 2166041A | 4/1986 | United Kingdom . |

*Primary Examiner*—Ramon O. Ramirez
*Attorney, Agent, or Firm*—Dennis T. Griggs

[57] ABSTRACT

A self-closing bag holder has first and second resilient clamp plates which are connected by hinges on opposite ends to permit the clamp plates to bend outwardly with respect to each other. The hinged clamp plate assembly provides an expandable collar for supporting a plastic bag in an upright orientation. The sidewall of the plastic bag is fitted through the collar and is folded about the clamp plates in an open mouth configuration. The bag sidewall is secured to the bag holder by spikes formed on opposite ends of the clamp plates, and also by the interlocking union of a mounting bracket and handle assembly. Self-closure is provided by the resilient clamp plates which retract into engagement with each other upon release.

15 Claims, 3 Drawing Sheets

SELF-CLOSING BAG HOLDER

FIELD OF THE INVENTION

This invention relates generally to apparatus for holding flexible bags in an upright collecting position, and in particular to a self-closing holder for plastic bags.

BACKGROUND OF THE INVENTION

Flexible plastic bags are in widespread use for collecting a wide variety of items, including wastepaper, food scraps and other disposable items which are commonly found in the kitchen, bathroom, nursery, garage/workshop, laundry room, and office. Because of their flexibility, plastic bags are not well adapted for stand-alone service, and are usually sized for insertion into a rigid metal or plastic container which supports the flexible bag in an upright orientation, with the bag sidewall being secured about the rim of the rigid container in an open arrangement. The disposable items are simply tossed into the open mouth of the bag, and when it has been filled, the bag is removed from the container and sealed with a plastic or metal tie strap. Typically, the sealed bag is then inserted into a larger disposal bag for pickup by a sanitation service. The larger bag is usually sealed by tie straps, or is itself enclosed within a large upright disposal container, which may be sealed by a removable lid.

DESCRIPTION OF THE PRIOR ART

It will be appreciated that a flexible plastic disposal bag cannot retain an open shape and will collapse without supporting structure. Even when a flexible disposal bag is inserted into an upright freestanding container, it is necessary to secure the bag about the upper rim of the container to prevent the sidewalls of the bag from collapsing inwardly to the bottom of the container in response to the weight of disposal items.

One limitation on the use of the conventional rigid container and plastic disposal bag combination is that the open mouth of the bag permits the escape of odors from food scraps, cleaning materials and the like, some of which may be toxic. Moreover, the open mouth of the traditional freestanding container combination exposes the waste contents to pets and children who may be tempted to handle or ingest the waste materials.

Another limitation on the use of the tradition disposal bag/rigid container combination is that the open mouth of the container is not aesthetically pleasing, and its contents will easily spill should the container be upset. Moreover, the exposed contents may be scattered about by pets and children, even if the container remains upright.

Yet another limitation on the use of such open containers for disposal of waste items is that the exposed contents may attract insects.

Still another limitation on the use of the traditional open bag/container combination is that such containers are usually free standing on the floor, and it is not practical to support the container at an elevation where the bag can be most conveniently used, for example, adjacent to a washer/dryer in the laundry room, adjacent to a workbench in a garage or workshop, under a desk, or adjacent to a changing table in a nursery for disposal of used baby products.

Consequently, it will be appreciated that while the open, freestanding waste container provides convenient disposal, there are significant limitations on its use, and the convenience is lost when a removable lid is utilized. Even the use of a removable lid has limitations since the lid is easily displaced should the rigid container be upset, and is subject to removal by children and pets.

OBJECTS OF THE INVENTION

The principal object of the present invention is to provide a holder for supporting a flexible bag in an upright collecting position, with the mouth of the bag being held open when the holder is expanded, and with the mouth of the bag being closed by the holder when the holder is released.

A related object of the present invention is to provide a bag holder of the character described which prevents the spillage of the bag's contents should the bag container be upset.

Another object of the present invention is to provide a bag holder having a releasable safety latch which requires manipulation and/or manual dexterity which makes its release difficult to achieve by children and pets.

Yet another object of the present invention is to provide a bag holder of the character described which can support a flexible disposal bag off the floor at a more convenient location.

Still another object of the present invention is to provide a bag holding assembly of the character described which provides secure, sealed disposal of waste items without the use of a removable lid.

SUMMARY OF THE INVENTION

The foregoing objects are achieved by a self-closing bag holder in which end portions of a pair of clamp plates are coupled together, thereby defining an expandable collar for engaging and supporting the tubular sidewall of a flexible bag. In the preferred embodiment, the end portions of the clamp plates are connected by hinge assemblies which permit the clamp plates to be extended outwardly and opened with respect to each other. A resilient bag is inserted between the clamp plates, and the bag sidewall is folded over the clamp plates. The bag sidewall is secured about the clamp plates in an open mouth configuration by engagement of piercing means mounted on one of the clamp plates, and by the clamping action provided by a removable mounting bracket and a removable handle assembly. A latch assembly is formed on the handle and o the mounting bracket for releasably securing the handle in interlocking engagement with the mounting bracket when the clamp plates are in the released, closed position.

Other features and advantages of the present invention will be appreciated by those skilled in the art upon reading the detailed description which follows with reference to the attached drawings, wherein:

DETAILED DESCRIPTION OF THE PREFERRED EMBODIMENT

Figure 1:
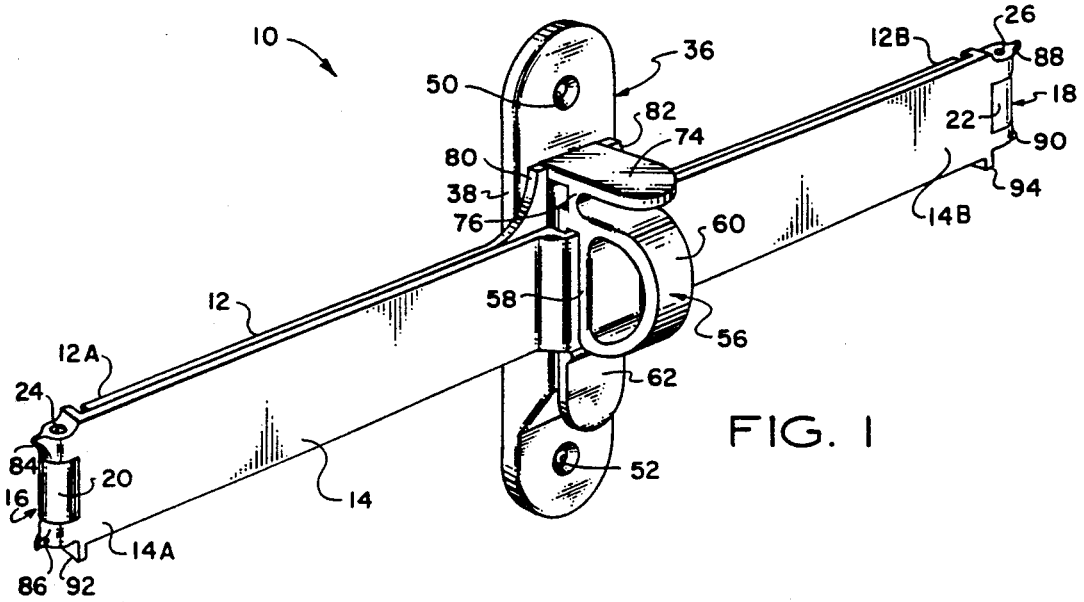
FIG. 1 is a perspective view of a self-closing bag holder constructed according to the teachings of the present invention.

In the description which follows, like parts are marked throughout the specification and drawings with the same reference numerals, respectively. The drawings are not necessarily to scale, and the proportions of certain parts have been exaggerated to better illustrate details and features of the invention.

Referring now to FIG. 1–FIG. 5, a self-closing bag holder 10 constructed according to the present invention has a first resilient clamp plate 12 assembled on a second resilient clamp plate 14, With the first and second clamp plates being superimposed in overlapping relation with each other in a closed position as shown in FIG. 1. The first clamp plate 12 has opposite end portions 12A, 12B which are coupled to corresponding end portions 14A, 14B of the second clamp plate 14. In this exemplary embodiment, the clamp plate end portions are coupled together by a first hinge assembly 16 and a second hinge assembly 18, respectively.

Figure 2:
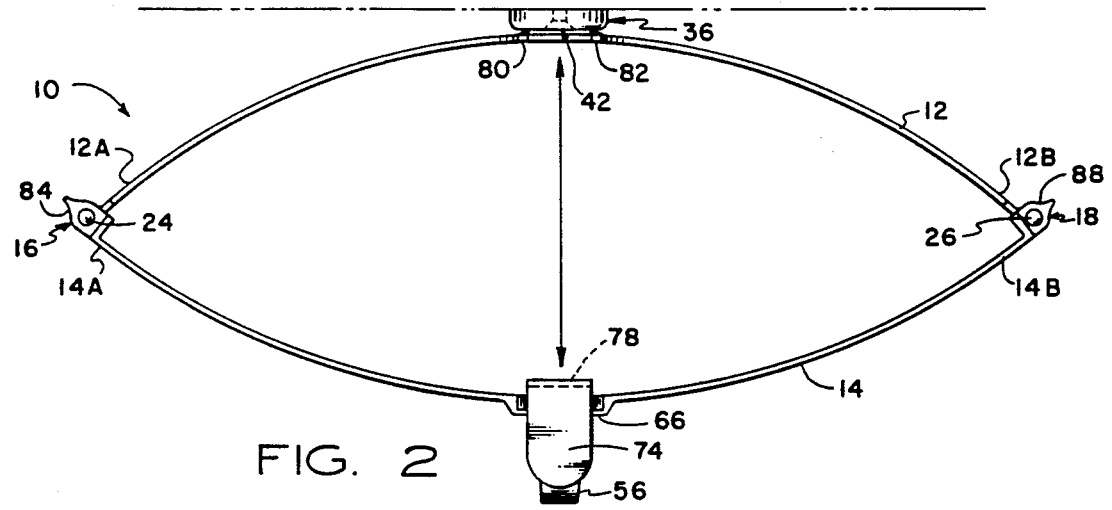
FIG. 2 is a top plan view of the bag holder of FIG. 1 shown in the open, extended position.
Figure 3:
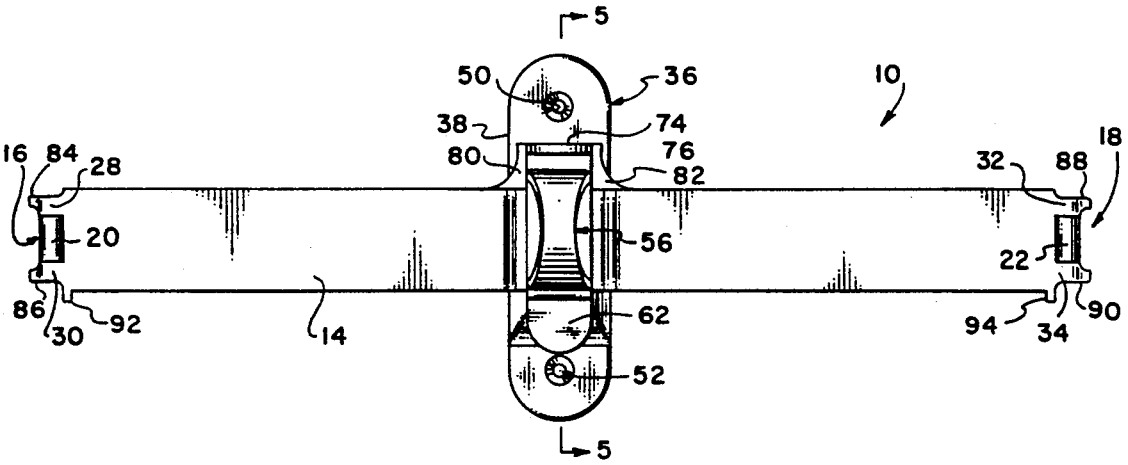
FIG. 3 is a front elevational view thereof.

The first and second hinge assemblies 16, 18 connect the opposite end portions of the clamp plates together for pivotal movement with respect to each other. The hinge plates 12, 14 are constructed of a resilient, plastic material which yields and bends smoothly outwardly to an open position as shown in FIG. 2 in response to an outwardly directed separation force.

Figure 4:
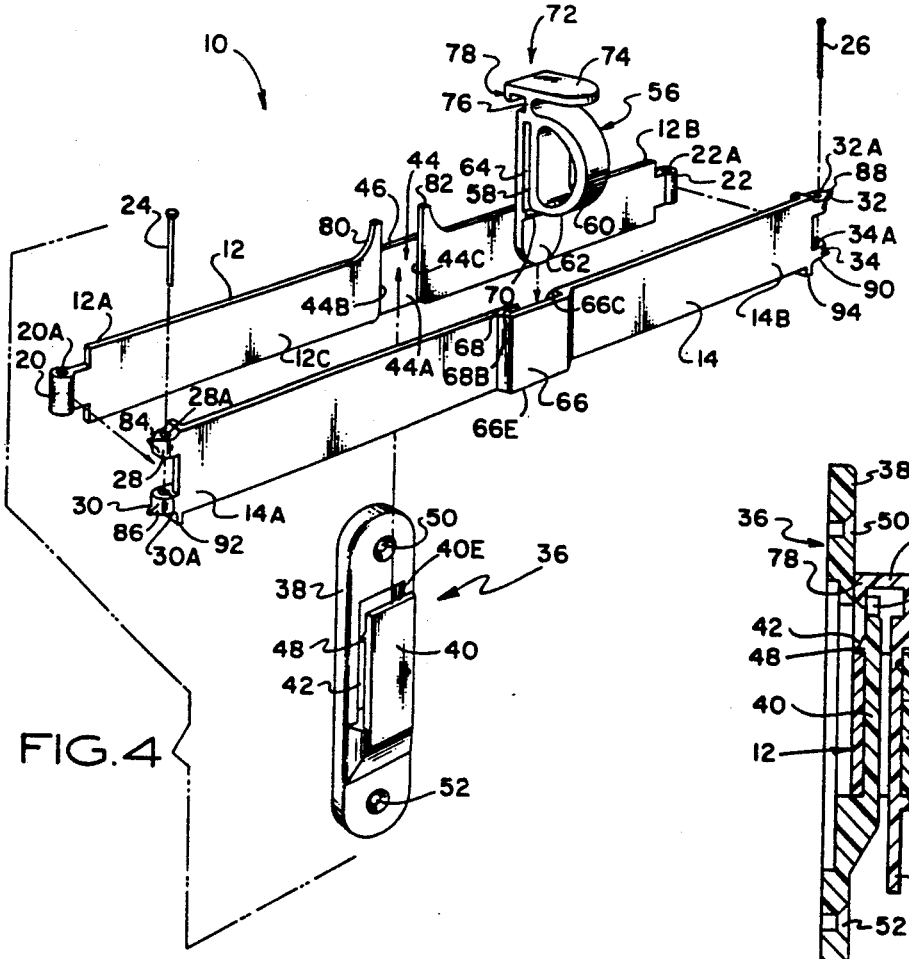
FIG. 4 is an exploded perspective view of the self-closing bag holder of FIG. 1.
Figure 5:
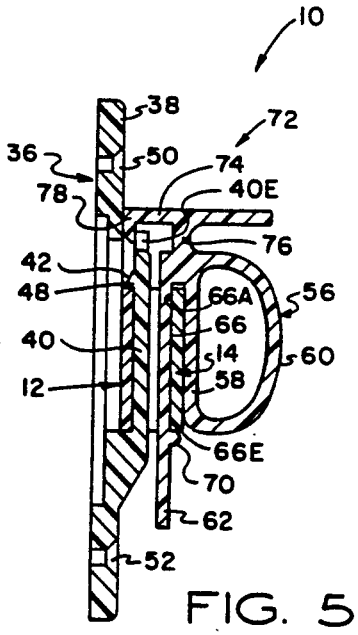
FIG. 5 is a sectional view thereof, taken along the lines 5—5 of FIG. 3.

Referring now to FIG. 4, the first and second hinge assemblies 16, 18 are constructed identically, and include sleeve bearings 20, 22 attached to the opposite end portions 12A, 12B of the first clamp plate 12. Each sleeve bearing 20, 22 has a straight bore 20A, 22A, respectively, for receiving hinge pins 24, 26, respectively. The second clamp plate 14 is fitted with hinge eyelets 28, 30 and 32, 34 on its opposite end portions 14A, 14B, respectively. The hinge eyelets 28, 30 and 32, 34 have straight bores 28A, 30A and 32A, 34A, respectively, for receiving the pins 24, 26. Moreover, the hinge eyelets 28, 30 are spaced apart to permit insertion of the sleeve bearing 20 in straight bore alignment between the adjacent hinge eyelets. Likewise, the hinge eyelets 32, 34 on the opposite end portion 14B are spaced apart to permit straight bore alignment of the sleeve bearing 22 with the bores 32A, 34A of the hinge eyelets on the opposite end portion.

Figure 6:
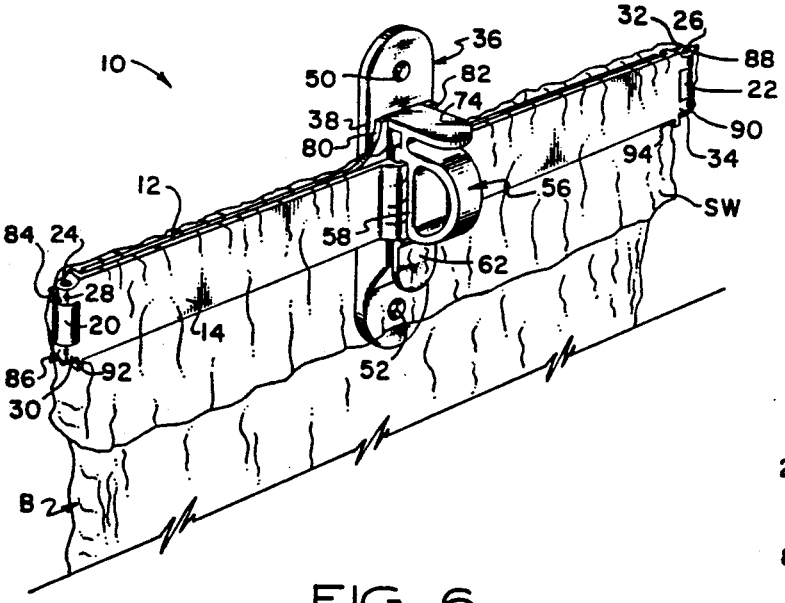
FIG. 6 is a perspective view of the self-closing bag holder of FIG. 1, with a plastic bag being suspended therefrom.

After the sleeve bearings are aligned, the hinge pins 24 are inserted through the aligned bores on opposite ends of the superimposed clamp plates. The hinge pins 24, 26, which are preferably constructed of aluminum, are then secured in place by staking. In this combination, the first and second clamp plates 12, 14 provide an expandable collar for supporting a flexible bag B in an upright collecting orientation, substantially as shown in FIG. 6 and in FIG. 8. The intermediate clamp plate portions bend smoothly along concave arches as the end portions pivot about the hinge pins 24, 26. That is, the hinge assemblies permit pivotal movement of the clamp plates with respect to each other, while preventing separation of their opposite end portions.

Figure 10:
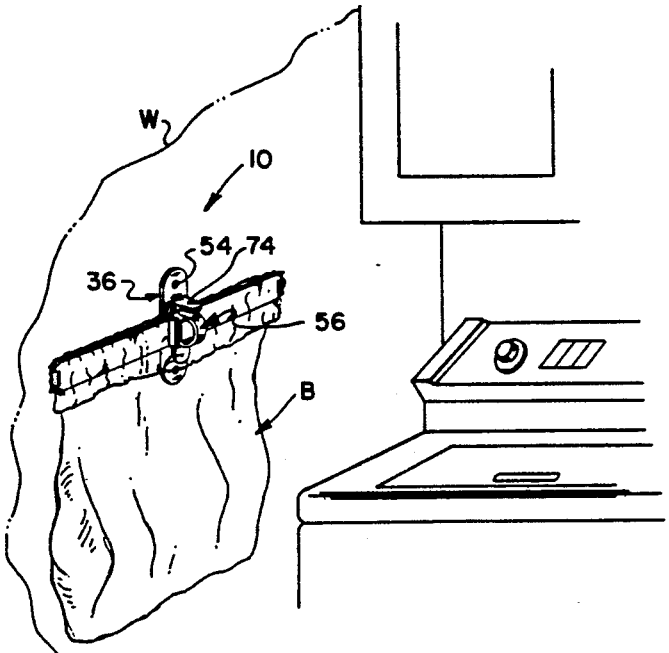
FIG. 10 is a perspective view showing a typical installation of the self-closing bag holder of the present invention on a laundry room wall; and, FIG. 11 is a perspective view showing a typical installation of the self-closing bag holder of the present invention on a door of a kitchen cabinet.

Referring again to FIG. 1, FIG. 2, and FIG. 4, a mounting bracket 36 is assembled on the first clamp plate 12. The mounting bracket 36 includes a base plate 38 which is adapted for attachment to an external support structure, for example the laundry room wall W as shown in FIG. 10, or the kitchen cabinet door D shown in FIG. 11. The mounting bracket 36 is releasably attached to the first clamp plate 12 by a retainer arm 40 which is attached to the base plate 38 in offset spaced relation, thereby defining an open slot 42 in which the first clamp plate 12 is received.

Referring again to FIG. 4, the inside surface 12C of the first clamp plate 12 is intersected by a channel 44 which extends transversely across the inside facing surface. The upper edge 46 of the clamp plate 12 within the channel 44 defines a striker edge for engaging a shoulder 48 when the mounting bracket 36 is inserted into the channel 44. The shoulder 48 rides on the clamp plate surface 44A of the channel 44, thereby causing the retainer arm 40 to deflect outwardly until the shoulder 48 clears the edge 46. When that occurs, the clamp plate 12 is releasably secured to the mounting bracket 36 by interlocking engagement of the shoulder 48 against the striker edge 46. The mounting bracket 36 is secured against lateral displacement by engagement of the retainer arm 40 against the sidewalls 44B, 44C of the channel 44. The mounting bracket 36 may be released by manually displacing the retainer arm 40 out of interfering engagement with the striker edge 46 and simultaneously withdrawing the mounting bracket downwardly out of the channel 44.

Figure 11:
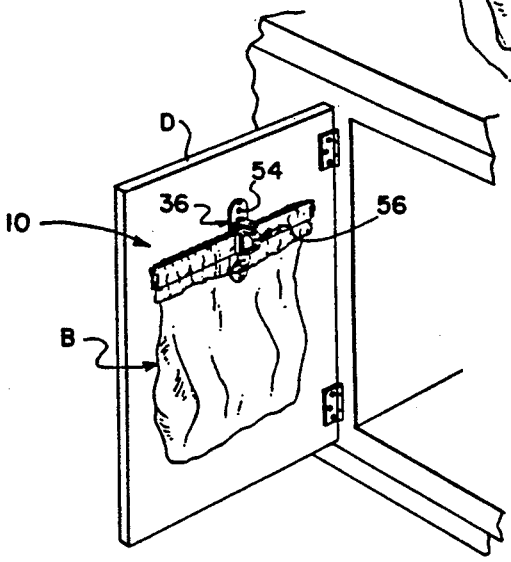

When the mounting bracket 36 is fully inserted within the channel 44, the clamp plate 12 is compressed between the base plate 38 and the retainer arm 40. Upon full insertion of the mounting bracket 36 within the channel 44, the shoulder 48 is driven into detented, interfering engagement with the striker edge 46, thereby securing the mounting bracket onto the clamp plate 12. The base plate 38 is intersected by a pair of bores 50, 52 for receiving wood screw fasteners 54. The mounting bracket 36 may be mounted against a wall W as shown in FIG. 10, or the interior surface of a cabinet door D as shown in FIG. 11. By this arrangement, the mounting bracket 36, together with the clamp plates 12, 14, can support a flexible disposal bag B off the floor in a convenient location as shown in FIG. 10 and FIG. 11.

Preferably, the retainer arm 40 is integrally formed with the base plate 38 and is constructed of a durable, high impact strength ABS polymer material.

Figure 8:
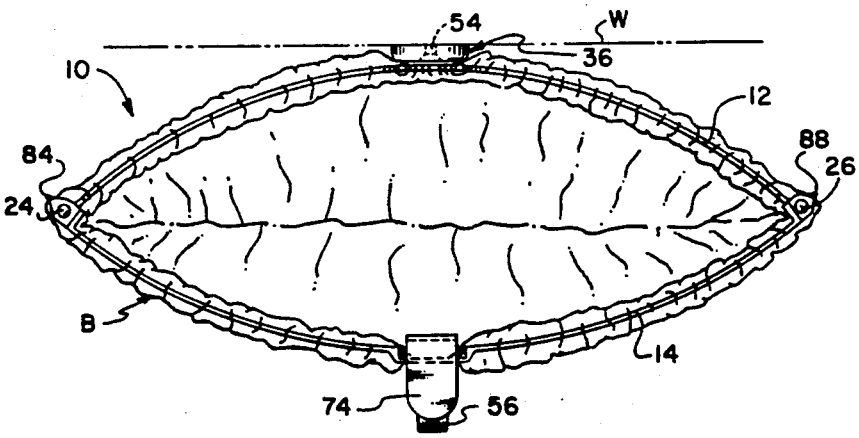
FIG. 8 is a top plan view showing the bag holder of the present invention in combination with a flexible plastic bag in the open mouth configuration.

Referring again to FIGS. 1–5, a handle 56 is releasably attached to the second clamp plate 14 for manually pulling the second clamp plate 14 to an open configuration as shown in FIG. 8. The handle assembly 56 includes a base plate 58, a handle portion 60, and a retainer arm 62. The retainer arm 62 is mounted on the base plate in offset relation therewith, thereby defining an open slot 64 in which the second clamp plate 14 is received.

Referring again to FIG. 1, FIG. 4, and FIG. 5, the second clamp plate 14 has an intermediate portion 66 which is radially upset with respect to the end portions 14A, 14B. The radially upset intermediate portion 66 defines a rectangular channel 68 in which the retainer arm 62 is inserted. When the retainer arm 62 is fully inserted, the intermediate clamp plate portion 66 is fully received within the open slot 64, and is compressed between the retainer arm 62 and handle base plate 58. As can best be seen in FIG. 5, the base plate 62 has a shoulder 70 which rides against the inside facing surface of the intermediate clamp plate portion 66 as the retainer arm 62 is inserted through the channel 68. As the shoulder 70 clears the lower edge 66E, it falls into detented, interfering engagement with the lower edge 66E. According to this arrangement, the handle assembly 56 is releasably secured to the clamp plate 14, and is prevented from movement by the channel edge portions 66B, 66C and by detented engagement of the shoulder 70 against the lower edge 66E. The handle assembly 56 may be released from engagement with the clamp plate 14 simply by deflecting the retainer arm 62 away from the handle base plate 58 sufficiently to permit the shoulder 70 to clear the lower edge 66E while pulling the handle 56 upwardly.

In the absence of an opening force, the clamp plates are drawn tightly together in the closed position as shown in FIG. 1 and FIG. 6. When it is desired to open the bag B for disposal of waste material, the handle 56 is pulled outwardly, thereby causing the forward clamp plate 14 to assume the arched, concave configuration as shown in FIG. 2. Upon release of the opening force, the energy stored in the arched clamp plates 12, 14 causes the clamp plates to be driven rapidly to the closed position as shown in FIG. 1 and FIG. 6.

Preferably, the mounting bracket 36 and handle assembly 56 are releasably locked together by a latch assembly 72. The latch assembly 72 includes a latch arm 74 attached to the handle 56. The latch arm 74 is connected to the handle assembly 56 by a web 76. The web 76 permits the latch arm 74 to deflect angularly with respect to the handle 56. The latch arm 74 has a transverse shoulder portion 78 which is insertable into the receiver slot 44 for detented, interlocking engagement with the edge portion 40E of the retainer arm 40.

The forward edge of the shoulder 78 is beveled to permit it to slide over the retainer arm edge 40E as the handle is driven into engagement with the retainer arm upon release of the clamp plate 14. As the beveled edge of the shoulder 78 clears the upper edge 40E, it drops into the channel 44 and becomes interlocked with the retainer arm 40 of the mounting bracket 36. This causes 14 the rear clamp plate 12 and forward clamp plate 14 to be releasably interlocked in the closed position as shown in FIG. 1 and FIG. 6.

Figure 9:
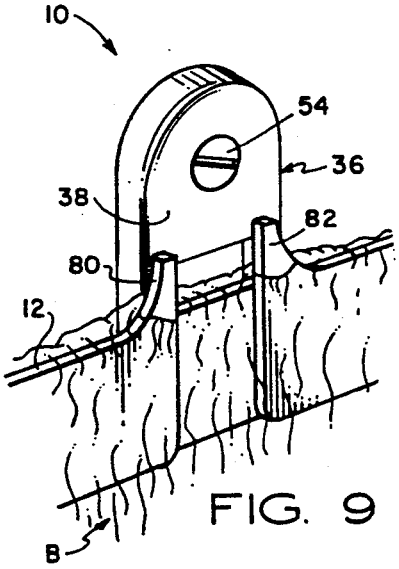
FIG. 9 is a perspective view, partially broken away, which illustrates retention of the plastic bag sidewall between a clamp plate and a mounting bracket.

The bag B is inserted between the clamp plates 12, 14, and its tubular sidewall SW is folded over and about the clamp plates 12, 14 as shown in FIG. 6. According to an important feature of the invention, the tubular sidewall SW of the flexible bag B is secured to the clamp plates 12, 14 by the clamping action of the mounting bracket 36 and handle assembly 56. Referring to FIG. 6, FIG. 8, and FIG. 9, the sidewall SW of the bag B is compressed within the channel 44 by the retainer arm 40 as the retainer arm 40 is inserted into the channel 44. Preferably, the edge portions 44B, 44C are terminated by cleats 80, 82 on which the bag sidewall SW is impaled, with the marginal edge of the bag sidewall being confined between the cleats 80, 82 and the base plate 38.

The forward marginal edge of the bag sidewall is folded over the forward clamp plate 14, and is compressed between the handle base plate 58 and the retainer arm 62 as the handle assembly is inserted onto the intermediate clamp plate portion 66.

Figure 7:
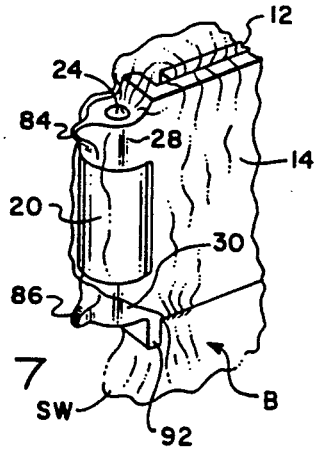
FIG. 7 is a perspective view, partially broken away, which illustrates engagement of the plastic bag by piercing means.

The marginal edge portions of the bag B are also secured by outwardly projecting spikes 84, 86 formed on the hinge eyelets 28, 30, respectively, and 88, 90 formed on the hinge eyelets 32, 34, respectively. The peripheral sidewall edge portion SW is impaled on the outwardly projecting spikes 84, 86 and 88, 90 as the sidewall material SW is pulled tightly against the clamp plates, as shown in FIG. 6 and FIG. 7. After the sidewall of the flexible bag B has been impaled on the spikes, the peripheral sidewall is pulled inwardly and is broken by the sharp edges of cleats 92, 94 which are formed on the underside of the clamp plate 14. The cleats 92, 94 also serve as retainers for preventing retraction of the folded over portion of the bag sidewall after the bag has been loaded. By this arrangement, the flexible bag B is securely fastened on the clamp plates 12, 14 by the cleats 80, 82, spikes 84, 86, 88, and 90, cleats 92, 94, mounting bracket 36, and handle assembly 56, which prevent the bag B from being pulled away from the clamp plates when fully loaded.

It will be appreciated that the bag holder 10 of the present invention will support a flexible disposal bag and the piercing cleats, spikes, and clamping action of the handle and mounting bracket prevent the bag from pulling away from the bag holder. It will be appreciated that the flexible plastic disposal bag will be supported upright for immediate service as the handle 56 is pulled outwardly. Moreover, the bag holder 10 is self-closing and will close automatically upon release of the handle 56. The interlocking engagement of the latch assembly 72 requires manipulation to release the shoulder 78 from interlocking engagement with the retainer arm 40, thereby securing the contents of the bag from pets and children who are unable to manipulate the latch. Additionally, the self-closing action seals the contents of the bag to prevent odors from food scraps, cleaning materials, and the like. Since the clamp plates 12, 14 are self-sealing and are locked by the latch assembly in the closed position, the contents will not spill, and the bag cannot be inadvertently upset since it is sealed by the interlocked clamp plates.

Although the invention has been described with reference to a specific embodiment, the foregoing description is not intended to be construed in a limiting sense. Various modifications to the disclosed embodiment as well as alternative applications of the invention will be suggested to persons skilled in the art by the foregoing specification and illustrations. It is therefore contemplated that the appended claims will cover any such modifications, applications, or embodiments which fall within the true scope of the invention.

What is claimed is:

1. Bag holding apparatus comprising, in combination:

a first resilient clamp plate having first and second end portions;

a second resilient clamp plate having first and second end portions;

the first clamp plate being assembled on the second clamp plate with the first end portion of the first clamp plate being coupled to the first end portion of the second clamp plate, and the second end portion of the first clamp plate being coupled to the second end portion of the second clamp plate; the assembly of the first and second clamp plates defining an expandable collar for engaging the tubular sidewall of a flexible bag; and a mounting bracket assembled on said first clamp plate, said mounting bracket including a base plate adapted for attachment to an external support structure and having a retainer arm attached to said base plate in offset relation therewith, thereby defining an open slot in which said first clamp plate is received.

2. Bag holding apparatus as defined in claim 1, comprising:

a mounting bracket having retainer portions disposed in releasable, interlocking engagement with said first clamp plate;

a handle assembly having retainer portions disposed in releasable, interlocking engagement with said second clamp plate; and latch means formed on said handle and said mounting bracket for releasably securing said handle in interlocking engagement with said mounting bracket.

3. Bag holding apparatus as defined in claim 2, wherein:

said first clamp plate having an inside surface facing said second clamp plate and having a channel formed transversely across the inside facing surface of said first clamp plate;

said second clamp plate having an inside surface facing said first clamp plate and having a channel formed transversely across the inside facing surface of said second clamp plate;

said mounting bracket having a base plate and a retainer arm mounted on said base plate in offset relation therewith, said mounting bracket retainer arm being received within the channel of said first clamp plate; and, said handle assembly including a base plate and a retainer arm mounted on said base plate in offset relation therewith, said handle retainer arm being received within the channel of said second clamp plate.

4. Bag holding apparatus as defined in claim 1, including:

a handle assembled on said second clamp plate for manually extending said second clamp plate relative to said first clamp plate; and a releasable latch assembly attached to said handle, said latch assembly including a latch arm attached to said handle and detent means formed on said first clamp plate for engaging said latch arm in a releasable, interlocking union when the first and second clamp plates are in the closed position.

5. Bag holding apparatus as defined in claim 1, said retainer arm having a shoulder rib projecting into said receiver slot for releasably retaining said first clamp plate in said receiver slot.

6. Bag holding apparatus as defined in claim 1, including:

bag piercing means formed on the first and second end portions of one of said clamp plates.

7. Bag holding apparatus as defined in claim 6, said second clamp plate including:

first and second hinge means formed on the first and second end portions of said second clamp plate, respectively, said piercing means projecting outwardly from said first and second hinge means.

8. Bag holding apparatus as defined in claim 4, including:

a mounting bracket having a base plate and a retainer arm mounted on said base plate in offset relation therewith, and said retainer arm having an edge portion engagable by said latch arm when the first and second clamp plates are in the closed position; and said latch arm including a shoulder portion projecting transversely with respect to said latch arm, said shoulder portion being insertable into said receiver slot for interlocking engagement with the edge portion of said retainer arm.

9. A self-closing bag holder comprising first and second resilient clamp plates connected together in a hinged union at opposite ends, respectively, said resilient clamp plates being yieldably extendable outwardly with respect to each other to a bag open position and being retractable toward each other to a bag closed position, said clamp plate assembly providing an expandable collar for supporting a flexible bag in an upright collecting orientation, a mounting bracket having retainer portions disposed in releasable, interlocking engagement with the first clamp plate, a handle assembly having retainer portions disposed in releasable, interlocking engagement with the second clamp plate, the retainer portions of said mounting bracket and said handle assembly being adapted for securing sidewall portions of a flexible bag onto said first and second clamp plates, respectively.

10. A self-closing bag holder as defined in claim 9, including bag piercing means formed on at least one of said clamp plates.

11. A self-closing bag holder as defined in claim 9, including:

coacting latch means formed on said handle and said mounting bracket for releasably securing said handle in interlocking engagement with said mounting bracket when the clamp plates are in the bag closed position.

12. A self-closing bag holder comprising first and second resilient clamp plates coupled together at opposite ends, respectively, said clamp plates being yieldably extendable outwardly with respect to each other to an open position and retractable toward each other to a closed position, said clamp plate assembly providing an expandable collar for supporting a flexible bag in an upright collecting orientation, a mounting bracket attached to said first clamp plate, and a handle assembly attached to said second clamp plate;

said mounting bracket having retainer portions disposed in releasable, interlocking engagement with said first clamp plate; and said handle assembly having retainer portions disposed in releasable, interlocking engagement with said second clamp plate.

13. A self-closing bag holder as defined in claim 12, said mounting bracket including a base plate adapted for attachment to an external support structure and having a retainer arm attached to said base plate in offset relation therewith, thereby defining an open slot in which said first clamp plate is received.

14. A self-closing bag holder as defined in claim 12, said handle assembly including a handle having a base plate and a retainer arm attached to said base plate in offset relation therewith, thereby defining an open slot in which said second clamp plate is received.

15. A self-closing bag holder comprising, in combination:

a first resilient clamp plate having first and second end portions;

a second resilient clamp plate having first and second end portions;

a first hinge assembly connecting the first end portions of the first and second clamp plates together for pivotal movement with respect to each other;

a second hinge assembly connecting the second end portions of the first and second clamp plates together for pivotal movement with respect to each other;

a mounting bracket having retainer portions disposed in releasable, interlocking engagement with said first clamp plate;

a handle assembly having retainer portions disposed in releasable, interlocking engagement with said second clamp plate; and, latch means formed on said handle and said mounting bracket for releasably securing said handle in interlocking engagement with said mounting bracket.

* * * * *

UNITED STATES PATENT AND TRADEMARK OFFICE

CERTIFICATE OF CORRECTION

PATENT NO. : 5,183,227

DATED : February 02, 1993

INVENTOR(S) : Gerald D. Wilhite

It is certified that error appears in the above-identified patent and that said Letters Patent is hereby corrected as shown below:

Column 2, line 48, "o" should be -- on --;

Column 3, line 31, "With" should be -- with --.

Signed and Sealed this

Twenty-third Day of November, 1993

*Attest:*

Bruce Lehman

BRUCE LEHMAN

*Attesting Officer*

*Commissioner of Patents and Trademarks*